US007650279B2

(12) United States Patent
Hiekata et al.

(10) Patent No.: US 7,650,279 B2
(45) Date of Patent: Jan. 19, 2010

(54) SOUND SOURCE SEPARATION APPARATUS AND SOUND SOURCE SEPARATION METHOD

(75) Inventors: Takashi Hiekata, Kobe (JP); Yohei Ikeda, Kobe (JP)

(73) Assignee: Kabushiki Kaisha Kobe Seiko Sho, Kyogo (JP)

( * ) Notice: Subject to any disclaimer, the term of this patent is extended or adjusted under 35 U.S.C. 154(b) by 373 days.

(21) Appl. No.: 11/819,311

(22) Filed: Jun. 26, 2007

(65) Prior Publication Data

US 2008/0027714 A1 Jan. 31, 2008

(30) Foreign Application Priority Data

Jul. 28, 2006 (JP) ..... 2006-207006

(51) Int. Cl.
*G10L 19/14* (2006.01)

(52) U.S. Cl. ..... 704/205; 702/189; 702/190

(58) Field of Classification Search ..... 704/205, 704/200, 203, 226, 228; 702/189, 190
See application file for complete search history.

(56) References Cited

U.S. PATENT DOCUMENTS 7,519,512 B2 * 4/2009 Spence et al. ..... 702/189

FOREIGN PATENT DOCUMENTS

EP 1 748 427 A1 7/2006
JP 2003-271168 3/2002

OTHER PUBLICATIONS

Hiroshi Saruwatari et al., "Blind Source Separation for Speech Based on Fast-Convergence Algorithm with ICA and Beamforming", Eurospeech, vol. 4, 2001, pp. 2603-2606, XP007004927.
Hiroshi Saruwatari et al., "Blind Source Separation Based on Sub-band ICA and Beamforming", ICSLP, Oct. 16, 2000, 4 pages, XP007010461.
Extended European Search Report for 07014083.5-1224, dated Jan. 31, 2008.

* cited by examiner

*Primary Examiner*—Huyen X. Vo
(74) *Attorney, Agent, or Firm*—Stites & Harbison, PLLC; Juan Carlos A. Marquez, Esq

(57) ABSTRACT

To shorten an output delay while a high sound source separation performance is ensured when a sound separation process based on an ICA method is performed. A second Fourier transform process execution cycle t2 for obtaining a second frequency-domain signal S1 used as an input signal of a filter process is set shorter than a first Fourier transform process execution cycle t1 for obtaining a first frequency-domain signal used for a learning computation of a separating matrix. When the time length of a second time-domain signal S1 is set shorter than a time length of a first time-domain signal S0, a second separating matrix used for a filter process is set by aggregating matrix components of a first separating matrix obtained through a learning calculation for every a plurality of groups.

16 Claims, 9 Drawing Sheets

CASE 1

CASE 2

CASE 3 g1: [DELAY TIME 192 ms] CONVENTIONAL RESULT
g2: [DELAY TIME 48 ms] FFT INPUT SIGNAL SIZE IS 1/4
gx1: [DELAY TIME 48 ms] RESULT (1) OF THE PRESENT INVENTION SECOND FFT INPUT IS MIXED SOUND SIGNAL BY 2N SAMPLES
gx2: [DELAY TIME 48 ms] RESULT (2) OF THE PRESENT INVENTION SECOND FFT INPUT IS ZERO PADDING SIGNAL INCLUDING MIXED SOUND SIGNAL BY 2N SAMPLES g1: [DELAY TIME 192 ms] CONVENTIONAL RESULT
g2: [DELAY TIME 48 ms] FFT INPUT SIGNAL SIZE IS 1/4
gx3: [DELAY TIME 48 ms] RESULT (3) OF THE PRESENT INVENTION MATRIX COEFFICIENT IS AGGREGATED AT AVERAGE VALUE
gx4: [DELAY TIME 48 ms] RESULT (4) OF THE PRESENT INVENTION MATRIX COEFFICIENT IS AGGREGATED AT SELECTIVE VALUE

FIG. 9A AT PROCESS START TIME

SOUND SOURCE SEPARATION APPARATUS AND SOUND SOURCE SEPARATION METHOD

BACKGROUND OF THE INVENTION

1. Field of the Invention

The present invention relates to a sound source separation apparatus and a sound source separation.

2. Description of the Related Art

When a plurality of sound sources and a plurality of microphones (equivalent to sound input units) in a predetermined sound space are present, a sound signal (hereinafter referred to as mixed sound signal) in which an individual sound signal (hereinafter referred to as sound source signal) from each of the plural sound sources is overlapped on another sound source signal is obtained from each of the plural microphones. A sound source separation method of (identifying) separating the respective sound source signals only on the basis of the thus obtained (input) plural mixed sound signals is called a blind source separation method, which will be hereinafter referred to as BSS-method. An example of a sound source separation process based on the sound input BSS method is a sound source separation process based on a method for an independent component analysis (hereinafter referred to as ICA).

The plural mixed sound signals (time-series (time-domain) sound signals) which are input through the plurality of microphones are statistically independent from each other. The sound separation process based on the ICA method includes a process for optimizing a predetermined separating matrix (inversed mixing matrix) through a learning computation on the basis of the input plural mixed sound signals on the promise that the mixed sound signals are statistically independent from each other. Furthermore, the sound separation process based on the ICA method includes performing a filter process (matrix operation) on the plural input mixed sound signals with use of the optimized matrix operation through the learning computation, thus identifying the sound signals (sound source separation).

Here, the optimization for the separating matrix based on the ICA method is performed through the learning computation, in which a calculation of a separation signal (identified signal) obtained by performing the filter process (matrix operation) on a mixed sound signal of a predetermined time length with use of on the separating matrix and an update of the separating matrix through an inverse matrix operation or the like with use of the separation signal are subsequently repeated.

The ICA method used for performing the sound source separation process based on the BSS method is roughly divided into an ICA method in Time-Domain (hereinafter referred to as the TDICA method) and an ICA method in Frequency-Domain (hereinafter referred to as FDICA method).

The TDICA method is a method with which the independence of the respective sound source signals over a wide frequency band in general. In the learning computation of the separating matrix, the convergence in the vicinity of the optimal point is high. For this reason, according to the TDICA method, it is possible to obtain the separating matrix with a high optimization level, and the sound source signals can be separated from each other at a high precision (high separation performance). However, the TDICA method requires an extremely complicated (high operational load) process for the learning computation of the separating matrix (a process for a convolutive mixture) and therefore is not suitable to a real time process.

On the other hand, the FDICA method, for example, disclosed in Japanese Unexamined Patent Publication Application No. 2003-271168, is a method for performing the learning computation of the separating matrix to change a problem of the convolutive mixture into a problem of instantaneous mixture for each of frequency bins which are frequency bands divided into plural pieces (which are sub bands in Japanese Unexamined Patent Publication Application No. 2003-271168) through a Fourier transform process for converting the mixed sound signal from the time-domain signal to the frequency-domain signal. According to this FDICA method, optimization (learning computation) of the separating matrix (the matrix to be used for the separation filter process) can be performed stably and also at a high speed. Therefore, the FDICA method is suitable to the real time sound source separation process.

Incidentally, according to the FDICA method, the number of the frequency bins (the number of the sub bands illustrated in Japanese Unexamined Patent Publication Application No. 2003-271168) in the frequency-domain mixed sound signal used for the learning computation of the separating matrix (hereinafter referred to as learning input signal) significantly affects the separation performance in a case where the filter process is performed with use of the separating matrix that is obtained through that learning computation. Here, it may be also mentioned that in the Fourier transform process, the number of the frequency bins of the output signal (the frequency-domain signal) is ½ times as many as the number of the samples of the input signal (the time-domain signal), and the number of the samples the mixed sound signal (the digital signal) that is the input of a Fourier transform process significantly affects the separation performance. Also, a sampling cycle at the time of A/D conversion of the mixed sound signal is constant, and therefore it may be mentioned that the time length of the mixed sound signal that is the input of the Fourier transform process significantly affects the separation performance.

For example, in a case where the sampling frequency of the mixed sound signal is 8 KHz, if the length (the frame length) of the input signal (the time-domain signal) of the Fourier transform process is set to about 1024 samples (128 ms in terms of time), that is, if the number of the frequency bins (the number of the sub bands) in the output signal (the frequency-domain signal) of the Fourier transform process is set to about 512, the high separation performance can be obtained (the separating matrix with the high separation performance can be obtained).

Next, while referring to FIG. 8, a description will be given of a conventional process procedure in a case of executing the sound source separation process based on the FDICA method in real time. FIG. 8 is a block diagram illustrating a conventional flow of a sound source separation process based on the FDICA method.

In an example illustrated in FIG. 8, the sound source separation process based on the FDICA method is executed by a learning computation unit 34, a second FFT processing unit 42', a separation filter processing unit 44', an IFFT processing unit 46', and a synthesis process unit 48'. The learning computation unit 34, the second FFT processing unit 42', the separation filter processing unit 44', the IFFT processing unit 46', and the synthesis process unit 48' are composed, for example, of a computation processor such as a DSP (Digital Signal Processor), a storage unit such as a ROM that stores a program to be executed by the processor, and other peripheral devices such as an RAM.

Also, for the convenience of description, the respective buffers illustrated in FIG. 8 (a first input buffer 31, a first intermediate buffer 33, a second input buffer 41', a second intermediate buffer 43', a third intermediate buffer 45', a fourth intermediate buffer 47', and an output buffer 49') are described as if the buffers can accumulate an extremely large amount of data. However, in actuality, data that is no longer necessary among the stored data is sequentially deleted in the respective buffers, and as a result the thus obtained free space is reused. Accordingly, the storage capacity of the respective buffers is set as a necessary and sufficient amount.

The mixed sound signal (the sound signal) of each channel digitalized at a constant sampling cycle is input (transmitted) to the first input buffer 31 and the second input buffer 41' by N samples each. For example, in a case where the sampling frequency of the mixed sound signal is 8 KHz, N=about 512 is established. In this case, the time length of the mixed sound signal by the N samples is 64 ms.

Then, each time a new mixed sound signal by the N samples is input to the first input buffer 31, a first FFT processing unit 32 executes the Fourier transform process on the latest mixed sound signal by the 2N samples including the N samples (hereinafter referred to as first time-domain signal S0), and a frequency-domain signal that is the resultant of the process (hereinafter referred to as first frequency-domain signal Sf0) is temporarily stored in the first intermediate buffer 33. Here, in a case where the number of the signal samples accumulated in the first input buffer 31 does not reach 2N (an initial stage after the process start), the Fourier transform process is executed on a signal to which the value 0 is replenished by a deficient number. The number of the frequency bins of the first frequency-domain signal Sf0 obtained by performing the Fourier transform process once in the first FFT processing unit 32 is ½ times as many as the number of samples of the first frequency-domain signal Sf0 (=N).

Then, each time the first intermediate buffer 33 records the first frequency-domain signal Sf0 by a predetermined time length T [sec], on the basis of the signal Sf0 by T [sec], the learning computation unit 34 performs the learning computation of a separating matrix W(f), that is, filter coefficients (matrix components) constituting the separating matrix W(f). Furthermore, the learning computation unit 34 updates, at a predetermined timing, the separating matrix used in the separation filter processing unit 44' into a separating matrix after the learning (that is, the value of the filter coefficients of the separating matrix is updated to the number after the learning). In a normal case, after the completion of the learning computation, immediately after the filter process of the separation filter processing unit 44' is ended for the first time, the learning computation unit 34 updates the separating matrix.

On the other hand, each time a new mixed sound signal by the N samples is input to the second input buffer 41', the second FFT processing unit 42' also executes the Fourier transform process on the latest mixed sound signal by the 2N samples including the N samples (hereinafter referred to as second time-domain signal S1), and a frequency-domain signal that is the process result (hereinafter referred to as second frequency-domain signal Sf1) is temporarily stored in the second intermediate buffer 43'. In this manner, the second FFT processing unit 42' executes the Fourier transform process on the second time-domain signal S1 (the mixed sound signal) in which time slots are overlapped one another by the N samples in sequence. Here, in a case where the number of the signal samples accumulated in the second input buffer 41' does not reach 2N (an initial stage after the process start), the Fourier transform process is executed on a signal to which the value 0 is replenished by a deficient number. It should be noted that the number of the frequency bins of this second frequency-domain signal Sf1 is also ½ times as many as the number of the samples of the second frequency-domain signal Sf1 (=N).

Then, each time the second intermediate buffer 43' records the new second frequency-domain signal Sf1, the separation filter processing unit 44' performs a filter process (matrix operation) with use of the separating matrix on the new second frequency-domain signal Sf1, and a signal obtained through the process (hereinafter referred to as third frequency-domain signal Sf2) is temporarily stored in the third intermediate buffer 45'. The separating matrix used in this filter process is to be updated by the above-described learning computation unit 34. It should be noted that until the separating matrix is updated for the first time by the learning computation unit 34, the separation filter processing unit 44' performs the filter process with use of the separating matrix (initial matrix) in which a predetermined initial value is set. Here, it is needless to mention that the second frequency-domain signal Sf1 and the third frequency-domain signal Sf2 have the same number of the frequency bins.

Also, each time the third intermediate buffer 45' records the new third frequency-domain signal Sf2, the IFFT processing unit 46' executes an inverse Fourier transform process on the new third frequency-domain signal Sf2, and a time-domain signal that is the resultant of the process (hereinafter referred to as third time-domain signal S2) is temporarily stored in the fourth intermediate buffer 47'. The number of this third time-domain signal S2 is 2 times as many as the number of the frequency bins (=N) of the third frequency-domain signal Sf2 (=2N). As described above, as the second FFT processing unit 42' executes the Fourier transform process on the second time-domain signal S1 (the mixed sound signal) in which time slots are overlapped one another by the N samples, the time slots are mutually overlapped by the N samples in the two continuous third time-domain signals S2 recorded in the fourth intermediate buffer 47'.

Furthermore, each time the fourth intermediate buffer 47' records the new third time-domain signal S2, the synthesis process unit 48' executes a synthesis process to be illustrated below to generate a new separation signal S3, which is temporarily recorded in the output buffer 49'.

Here, the above-described synthesis process is a process for synthesizing both the signals at a part where the time slots are overlapped one another (a signal by the N samples each) in the new third time-domain signal S2 obtained in the IFFT processing unit 46' and the third time-domain signal S2 obtained one time before, through addition by a crossfade weighting, for example. As a result, the smoothed separation signal S3 is obtained.

By way of the above-described process, although some delay is (time delay) is caused with respect to the mixed sound signal, the separation signal S3 corresponding to the sound source is recorded in the output buffer 49' in real time.

Also, the separating matrix used in the filter process is appropriately updated so as to be adapted to a change in acoustic environment by the learning computation unit 34.

Next, while referring to FIGS. 9A to 9E, the output delay illustrated in FIG. 8 caused by the conventional sound source separation process will be described. FIGS. 9A to 9E are block diagrams illustrating a state transition of the signal input and output in a conventional sound source separation process based on the FDICA method.

Here, the output delay refers to a delay from a time point when the mixed sound signal is generated to a separation signal separated and generated from the mixed sound signal is output.

Hereinafter, a buffer for temporarily storing the mixed sound signal (the digital signal) obtained through an A/D conversion process is denoted by an input buffer 23. From this input buffer 23, the mixed sound signal by the N samples is transferred to the first input buffer 31 and the second input buffer 41'. Also, in FIGS. 9A to 9E, an input point Pt1 represents a signal write position with respect to the input buffer 23 (an instruction position of a write pointer), and an output point Pt2 represents a signal read position from the output buffer 49' (an instruction position of a read pointer). The input point Pt1 and the output point Pt2 are sequentially moved in synchronism with the same cycle as the sampling cycle of the mixed sound signal. Also, the input point Pt1 and the output point Pt2 are cyclically moved in each of the input buffer 23 and the output buffer 49' having a storage capacity of 2N samples.

FIG. 9A represents a state at the time of the process start. No signals are accumulated in both the input buffer 23 and the output buffer 49' (for example, a state where value 0 is embedded).

FIG. 9B represents a state after the state of FIG. 9A, in which new signals are written in the input buffer 23 in accordance with the movement of the input point Pt1 in sequence and the signal by the N samples is accumulated. At this time, the signal by the N samples (the signal denoted by input (1) in the drawing) is transferred to a unit for performing the sound source separation process (hereinafter referred to as sound source separation process unit A), and the sound source separation process is executed.

To be more specific, the signal by the N samples is transferred to (recorded in) the first input buffer 31 and the second input buffer 41', and the sound source separation process described on the basis of FIG. 8 is executed. Also, in the input buffer 23, the signal after the transfer to the sound source separation process unit A is ended is deleted.

FIG. 9C represents a state after the state of FIG. 9B, in which the sound source separation process unit A generates a separation signal by the N samples (the signal denoted by output (1) in the drawing), and the separation signal is written in the output buffer 49'. This separation signal (the output (1)) is equivalent to the separation signal S3 in FIG. 8.

In this state of FIG. 9C, the output point Pt2 is at a position where the separation signal is not written, and therefore the separation signal (the output (1)) is not output yet.

FIG. 9D represents a state after the state of FIG. 9C, in which a further new signal is written in the input buffer 23, and the next signal by the N samples (the signal denoted by input (2) in the drawing) is accumulated. At this time, the next signal by the N samples (the input (2)) is transferred to the sound source separation process unit A, and the sound source separation process is executed.

In this state of FIG. 9D, as the output point Pt2 is at the write position of the previous separation signal (the output (1)), the output of the separation signal (the output (1)) is started.

FIG. 9E represents a state after the state of FIG. 9D, in which a new separation signal by the N samples is generated by the sound source separation process unit A (the signal denoted by output (2) in the drawing), and the separation signal is written in the output buffer 49'. Between the time point of FIG. 9D to the time point of FIG. 9E, in accordance with the movement of the output point Pt2, the previous separation signal (the output (1)) is sequentially output by 1 sample each. Also, the signal after the output is ended is deleted in the output buffer 49'.

As is apparent from FIGS. 9A to 9E, in the conventional sound source separation process, the output delay equivalent to the time length of the next signal by the 2N samples is caused between the time point of FIG. 9A to the time point of FIG. 9D with respect to the signal delivery and receipt in the prior stage and the subsequent stage of the sound source separation process unit A. Furthermore, in the sound source separation process unit A as well, through the above-described synthesis process performed by the synthesis process unit 48', the output delay equivalent to the time length of the next signal by the N samples is caused. Therefore, in the conventional sound source separation process, there is a problem in that the output delay equivalent to the time length of the next signal by the 3N samples is caused in total.

For example, when the sampling frequency of the signal is 8 KHz, if the 1 frame is set as the signal of 1024 samples (that is, N=512) so that the separating matrix with the high separation performance can be obtained through the FDICA method, the output delay of 192 [msec] is caused.

This output delay of 192[msec] is a hardly accepted delay in an apparatus that operates in real time. For example, a delay time in communication in a digital mobile phone is, in general, equal to or smaller than 50 [msec]. When the sound source separation based on the conventional FDICA method is applied to this digital mobile phone, the total delay time becomes 242 [msec], which is unpractical. In a similar way, when the sound source separation based on the conventional FDICA method is applied to a hearing aid as well, a time deviation between an image viewed by eyes of the user and a sound which is heard through the hearing aid is too large, which is unpractical.

Here, by setting a positional relation between the input point Pt1 and the output point Pt2 different from a positional relation illustrated in FIGS. 9A to 9E in advance, the output delay can be set equal to or smaller than the time length of the next signal by the 3N samples. However, in that case too, the output delay is merely shortened to a time obtained by adding a time required to perform the sound source separation process to the time length of the next signal by the 2N samples. That is, according to the sound source separation process based on the FDICA method, the time of the output delay becomes a time more than 2 times or about 3 times as longer as the execution cycle of the Fourier transform process (the process of the second FFT processing unit 42') for obtaining the frequency-domain signal Sf1 used as the input signal of the filter process (the time length tN of the signal by the N samples).

On the other hand, the time of the output delay can be shortened when the length of 1 frame is set short (the number of samples is set small). However, the shortening of the length of 1 frame causes a problem in that the sound source separation performance is deteriorated.

SUMMARY OF THE INVENTION

An object of the present invention is to provide a sound source separation apparatus and a sound source separation method with which when a sound separation process based on an ICA method is performed, while a high sound source separation performance is ensured, it is possible to shorten an output delay (a delay from a time point when the mixed sound signal is generated until a separation signal separated and generated from the mixed sound signal is output). It should be noted that in this specification, "sound" is used as a term representing a concept that includes various acrostics without a limitation to a voice made by a human being. Also, in this specification, "operation", "calculation", and "computation" are synonymous with each other.

The sound source separation apparatus and the sound source separation method according to an aspect of the present invention have the following fundamental configurations and effects described in items (1) to (8).

(1) A unit for sequentially digitalizing a plurality of sound source signals from a plurality of sound sources at a constant sampling cycle to output the signals as a plurality of (plural-channel) mixed sound signals (digital signals) (hereinafter referred to as sound input unit).

(2) A unit for performing, each time the mixed sound signal by a length of a predetermined first time t1 is newly obtained, a Fourier transform process on the latest mixed sound signal by a length equal to or longer than the first time t1 (hereinafter referred to as first time-domain signal), and for temporarily storing a signal obtained through the Fourier transform process (hereinafter referred to as first frequency-domain signal) in a storage unit (hereinafter referred to as first Fourier transform unit).

(3) A unit for performing a leaning calculation through a frequency-domain independent component analysis method (FDICA method) on the basis of one or a plurality of the first frequency-domain signals to calculate a separating matrix (hereinafter referred to as first separating matrix) (hereinafter referred to as separating matrix learning calculation unit).

(4) A unit for setting and updating a matrix (hereinafter referred to as second separating matrix) used for a separation generation (that is, a filter process) of a separation signal that is a sound source signal corresponding to one or a plurality of the sound sources on the basis of the first separating matrix (hereinafter referred to as separating matrix setting unit).

(5) A unit for performing, each time the mixed sound signal by a length of a predetermined second time t2 that is shorter than the above-described first time t1, a Fourier transform process on a signal that includes the latest mixed sound signal having a length two times as long as the second time length t2 (hereinafter referred to as second time-domain signal), and for temporarily storing a signal obtained through the Fourier transform process (hereinafter referred to as second frequency-domain signal) in a predetermined storage unit (hereinafter referred to as second Fourier transform unit).

(6) A unit for performing, each time the second frequency-domain signal is newly obtained, a filter process based on the second separating matrix, and for temporarily storing a signal obtained as a result of the filter process (hereinafter referred to as third frequency-domain signal) in a storage unit (hereinafter referred to as separation filter process unit).

(7) A unit for performing, each time the third frequency-domain signal is newly obtained, an inverse Fourier transform process on the third frequency-domain signal, and for temporarily storing a signal obtained through the inverse Fourier transform process (hereinafter referred to as third time-domain signal) in a predetermined storage unit (hereinafter referred to as inverse Fourier transform unit).

(8) A unit for synthesizing, each time the third time-domain signal is newly obtained, both the signals at a part where time slots of the third time-domain signal and the third time-domain signal obtained one time before are overlapped one another to generate the separation signal (hereinafter referred to as signal synthesis unit). Here, in the items (1) to (8) described above, when a description in which an identification is made on the basis of "the length of the time" of the signal and the long or short length thereof is substituted by a description in which an identification is made on the basis of "the number of the samples" of the signal and the large or small number thereof, the contents of the description before and after the substitution is made represent the same meaning.

As described above, in the sound source separation process based on the FDICA method, the time of the output delay becomes a time from more than 2 times to about 3 times as long as the execution cycle of the Fourier transform process for obtaining the frequency-domain signal (the above-described signal Sf1) used as the input signal of the filter process.

In contrast, in the sound source separation apparatus according to the present invention, the execution cycle of the Fourier transform (the above-described second time t2) for obtaining the second frequency-domain signal used as the input signal of the filter process (the process of the second Fourier transform unit) is shorter than the execution cycle of the Fourier transform (the above-described first time t1) for obtaining the frequency-domain signal used for the learning computation of the separating matrix (the process of the first Fourier transform unit). Therefore, by setting the above-described second time t2 sufficiently short as compared with the conventional case (which is equivalent to a case where the number of samples N in FIGS. 9A to 9E is set small), it is possible to significantly shorten the time of the output delay as compared with the conventional case.

On the other hand, the execution cycle (the above-described first time t1) of the Fourier transform process (the process of the first Fourier transform unit) corresponding to the learning computation of the separating matrix can be set as a sufficiently long time (for example, this is equivalent to the signal having the length of the sampling cycle of 8 KHz× 1024 samples) irrespective of the above-described second time t2. As a result, while the time of the output delay is shortened, it is possible to ensure the high sound source separation performance.

Incidentally, in the Fourier transform process, the number of the frequency bins of the output signal (the frequency-domain signal) is ½ times as many as the number of samples of the input signal (the time-domain signal). Also, the number of the matrix components of the separating matrix (that is, the filter coefficients) obtained through the leaning calculation based on the FDICA method is the same as the number of the frequency bins in the first frequency-domain signal used for the leaning calculation.

Furthermore, the number of the frequency bins in the input signal of the filter process (the first frequency-domain signal) and the number of the matrix components of the separating matrix used for the filter process (the number of the filter coefficients) must be matched to each other.

Here, if the time length of the first time-domain signal and the time length of the second time-domain signal are set equal to each other (that is, the numbers of the samples in both the signals are the same), the number of the frequency bins in the signal obtained through the process of the first Fourier transform unit and the number of the frequency bins in the signal obtained through the process of the second Fourier transform unit are matched to each other. In this case, the separating matrix setting means can set the first separating matrix as the second separating matrix as it is.

On the other hand, in a case where the time length of the second time-domain signal is set shorter than the time length of the first time-domain signal, the number of the matrix components of the first separating matrix obtained through the learning calculation is larger than the number of the matrix components necessary and sufficient in the separating matrix used for the filter process. Therefore, the separating matrix setting means cannot the first separating matrix as the second separating matrix as it is.

In this case, the separating matrix setting means sets the matrix obtained by aggregating the matrix components constituting the first separating matrix for every a plurality of groups as the second separating matrix.

As a result, it is possible to set the separating matrix of the filter process (the second separating matrix) in which the necessary and sufficient number of the matrix components (the filter coefficients) are set.

Here, in a case where the time length of the second time-domain signal is set shorter than the time length of the first time-domain signal, an integer multiple equal to or larger than 2 times as long as the time length of the second time-domain signal is desirably set as the time length of the first time-domain signal.

As a result, a corresponding relation between the group of the matrix components in the first separating matrix and the matrix components of the second separating matrix becomes explicit.

Also, the above-described aggregation in the separating matrix setting means refers to, for example, with respect to the matrix components constituting the first separating matrix, a selection of one matrix component for every a plurality of groups and a calculation of an average value or a weighted average value of the matrix components for every a plurality of groups.

Here, the Fourier transform process corresponding to the learning calculation and the Fourier transform process corresponding to the filter process have different time lengths of the input signals (the numbers of the samples), which may be thought to affect the sound source separation performance. However, from an experimental result to be described later, the effect is relatively small.

Also, the second time-domain signal may be the following signal.

For example, it is conceivable that the second time-domain signal is the latest mixed sound signal having a predetermined time length 2 times as long as the second time length.

Alternatively, it is also conceivable that the second time-domain signal is a signal in which a predetermined number of constant signals (for example, zero-value signals) are added to the latest mixed sound signal by the time length 2 times as long as the second time length. It should be noted that the zero-value signal is a signal having a value of 0.

Moreover, the present invention can be also grasped as the sound source separation method of executing the processes, which are executed by the respective units of the sound source separation apparatus illustrated in the above, by a predetermined processor.

According to the present invention, by setting the execution cycle (the above-described second time t2) for the Fourier transform for obtaining the second frequency-domain signal used as the input signal of the filter process (the process of the second Fourier transform unit) sufficiently short, it is possible to significantly shorten the time of the output delay as compared with the conventional case.

Furthermore, the execution cycle (the above-described first time t1) for the Fourier transform corresponding to the learning computation of the separating matrix (the process of the first Fourier transform unit) can be set as a sufficiently long time (for example, this is equivalent to the signal having the length of the sampling cycle of 8 KHz×1024 samples) irrespective of the above-described second time t2. As a result, while the time of the output delay is shortened, it is possible to ensure the high sound source separation performance.

BRIEF DESCRIPTION OF THE DRAWINGS

FIGS. 9A to 9E are block diagrams illustrating a state transit of signal input and output in the sound source separation process based on the conventional FDICA method.

DESCRIPTION OF THE PREFERRED EMBODIMENTS

First of all, before a description will be given of embodiments of the present invention, a learning computation of a separating matrix based on an FDICA method is described with reference to FIG. 7.

Figure 7:
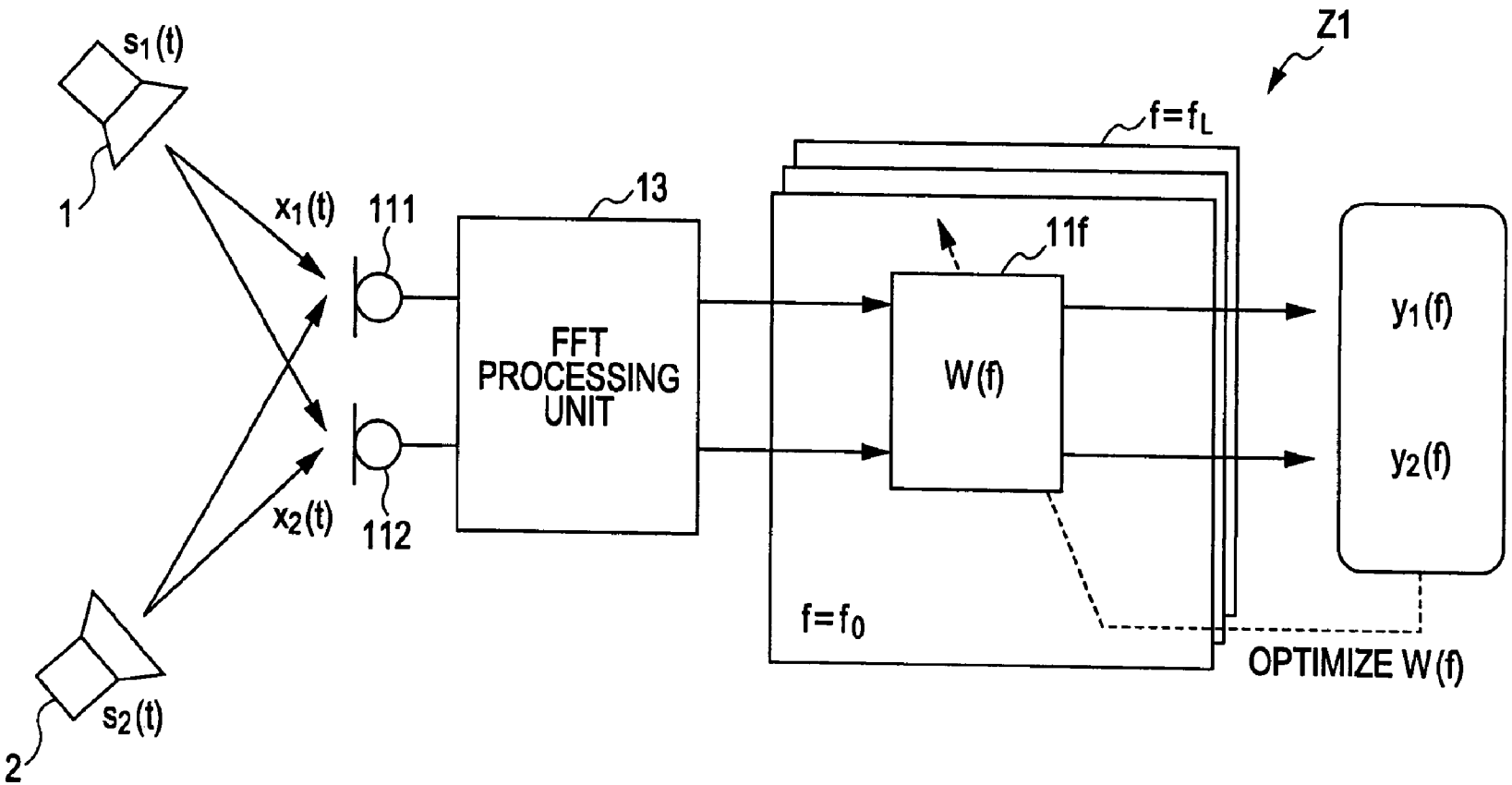
FIG. 7 is a block diagram illustrating a schematic configuration of a learning calculation unit for performing a learning computation of a separating matrix based on an FDICA method.

FIG. 7 is a block diagram illustrating a schematic configuration of a learning calculation unit Z1 for performing a learning computation of a separating matrix based on an FDICA method.

FIG. 7 illustrates an example where a learning calculation of a separating matrix W(f) is performed on sound source signals S1(*t*) and S2(*t*) from two sound sources 1 and 2 based on mixed sound signals x1(*t*) and x2(*t*) of two channels input through two microphones 111 and 112 (the channels corresponding to the respective microphones, but same applies to a case even if there are more than 2 channels. It should be noted that the mixed sound signals x1(*t*) and x2(*t*) are digitalized signals by an A/D converter at a constant sampling cycle (which may be called a constant sampling frequency), but in FIG. 7, a presence of the A/D converter is omitted.

According to the FDICA method, first, an FFT processing unit 13 performs a Fourier transform process on respective frames that are signals where the input mixed sound signal x(t) is sectioned for each a predetermined cycle (a predetermined number of samples). As a result, the mixed sound signal (the input signal) is converted from a time-domain signal into a frequency-domain signal. A signal after the Fourier transform becomes a signal sectioned for each frequency band in a predetermined range called frequency bins. Then, a separation filter processing unit 11*f* performs a filter process (a matrix operation process) based on the separating matrix W(f) on the signal of the respective channels after the Fourier transform process to conduct a sound source separation (an identification of a sound source signal). Here, when f denotes the frequency bins and m denotes the analysis frame number, the separation signal (the identification signal) y(f, m) can be represented by Expression (1) below.

Expression (1)

$$Y(f,m)=W(f)\cdot X(f,m) \tag{1}$$

Then, the separation filter (the separating matrix) W(f) in Expression (1) is obtained when a processor not shown in the drawing (for example, a CPU provided to a computer) executes a sequential calculation (a learning calculation) in which a process represented by the following Expression (2) (hereinafter referred to as unit process) is repeatedly performed. Here, when the unit process is executed, first, the processor apples a previous output y(f) of (i) to Expression (2) to obtain W(f) (i+1) of this time. Here, the separating matrix W(f) is a matrix having the filter coefficients respectively corresponding to the frequency bins as the matrix components, and the learning calculation is a calculation for finding out the respective values of the filter coefficients.

Furthermore, the processor performs the filter process (the matrix operation) with use of the W(f) obtained this time on the mixed sound signal (the frequency-domain signal) by the predetermined time length, thereby obtaining an output y(f) of (i+1) this time. Then, the processor repeatedly performs the series of these processes (the unit processes) for plural times, whereby the separating matrix W(f) will gradually have a context suited to the mixed sound signal used in the above-described sequential calculation (the learning calculation).

Expression (2)

$$W_{(ICA1)}^{[i+1]}(f) = W_{(ICA1)}^{[i]}(f) - \eta(f)\left\lfloor \text{off} - diag\left\{\left\langle \varphi(Y_{(ICA1)}^{[i]}(f,m))Y_{(ICA1)}^{[i]}(f,m)^H \right\rangle_m\right\}\right\rfloor W_{(ICA1)}^{[i]}(f) \tag{2}$$

Wherein η (f) denotes an update coefficient, i denotes the number of updates, < . . . > denotes a time average, and H denotes Hermite transpose. off-diag X denotes an operation process for replacing all diagonal elements of the matrix X with zero. ϕ( . . . ) denotes an appropriate non-linear vector function having a sigmoid function or the like as a component.

Figure 1:
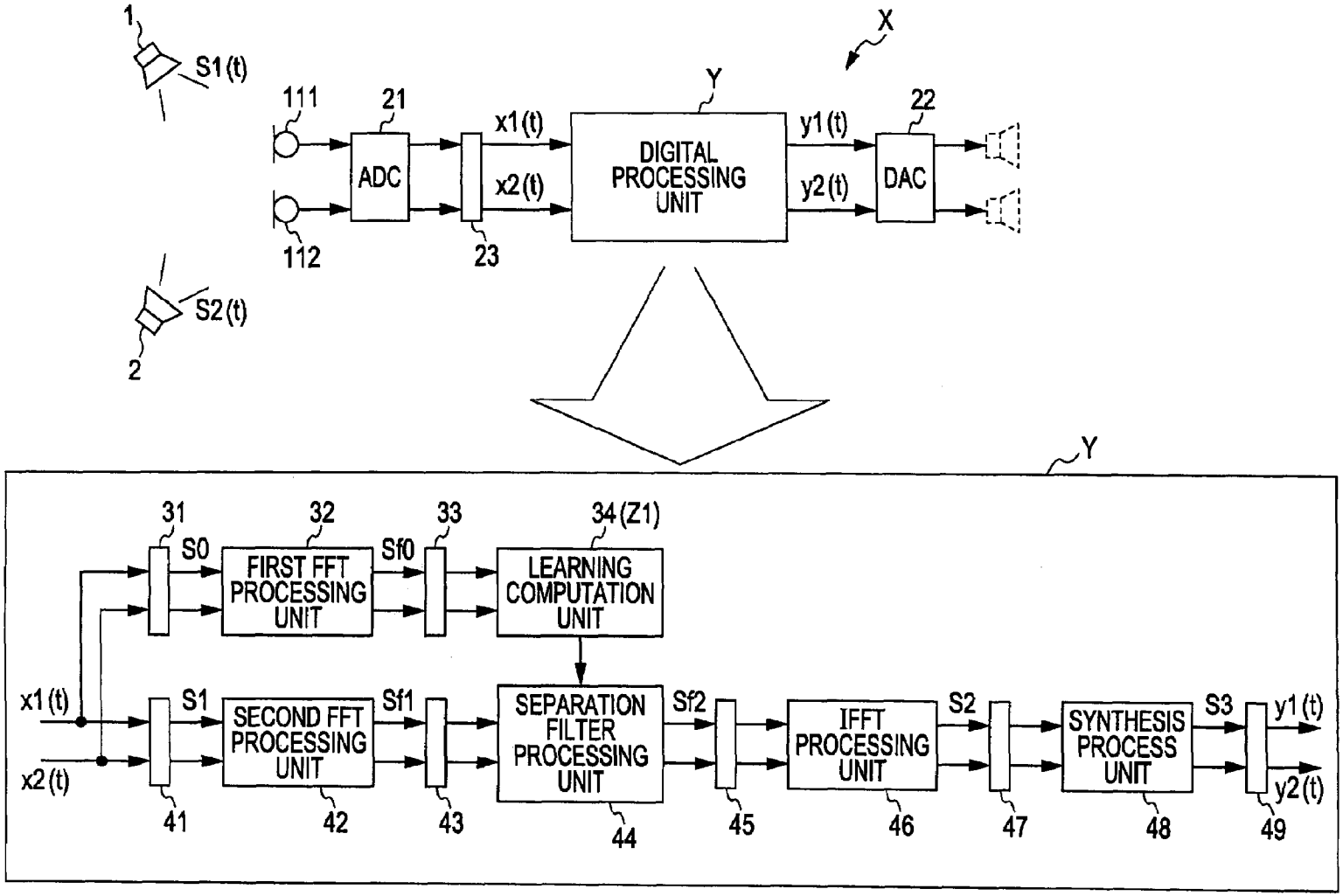
FIG. 1 is a block diagram illustrating a schematic configuration of a sound source separation apparatus according to an embodiment of the present invention.
Figure 2:
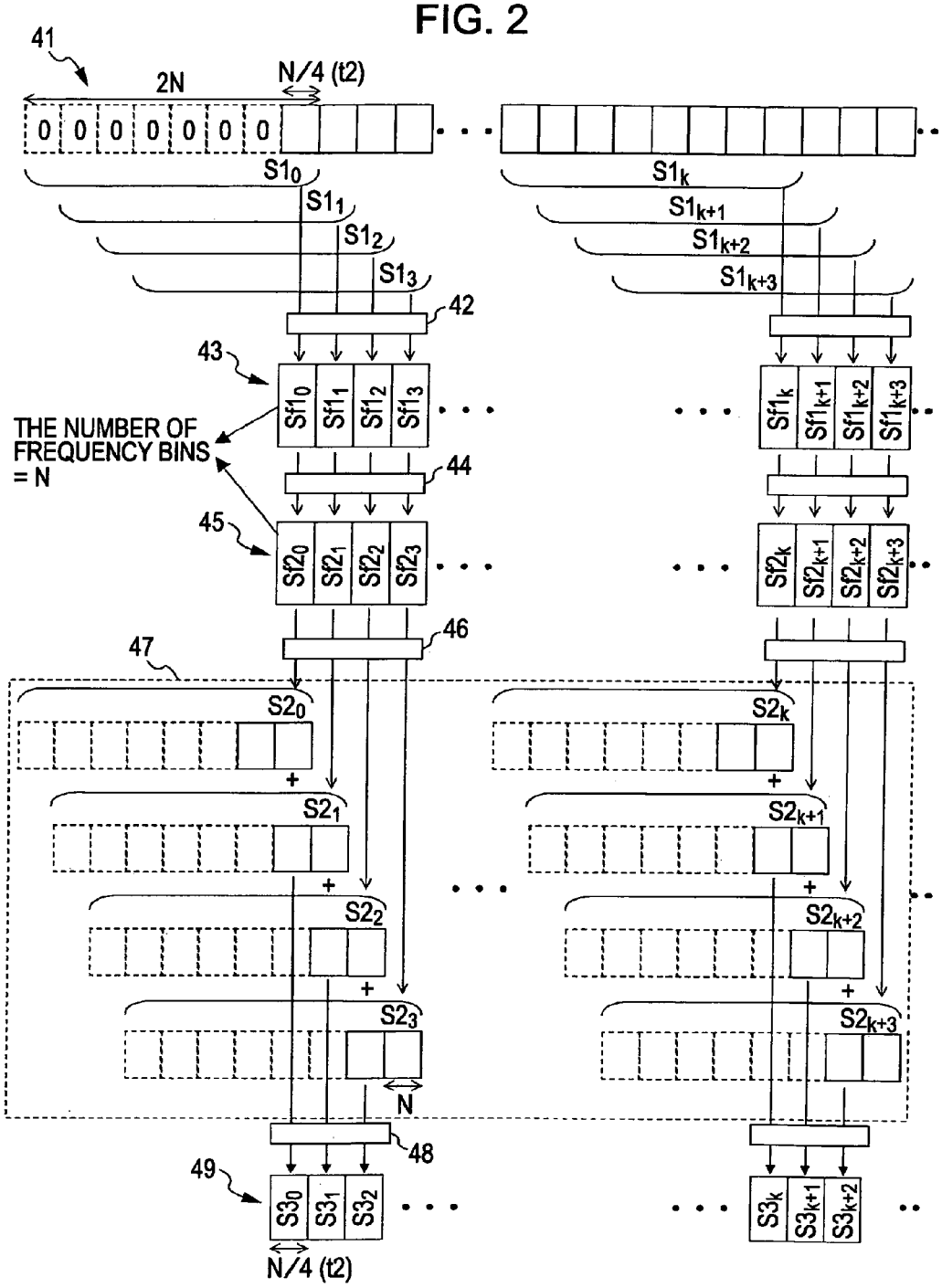
FIG. 2 is a block diagram illustrating a flow of a filter process (a first embodiment) in the sound source separation apparatus.

First Embodiment (Refer to FIGS. 1 and 2)

Hereinafter, with reference to a block diagram illustrated in FIG. 1, a description will be given of a sound source separation apparatus X according to an embodiment of the present invention. It should be noted that the following embodiment is an example that embodies the present invention, and does not have a nature of limiting the technical range of the present invention. The sound source separation apparatus X is connected to the plurality of microphones 111 and 112 (the sound input units) arranged in an acoustic space where the plural sound sources 1 and 2 are present.

Then, the sound source separation apparatus X sequentially generates, from the plurality mixed sound signals xi(t) that are sequentially input through the respective microphones 111 and 112, a separation signal (that is, a signal in which a sound source signal is identified) yi(t) corresponding to at least one of the sound sources 1 and 2 is separated (identified) and outputs the signal to a speaker (a sound output unit) in real time. Here, the mixed sound signal is a digital signal in which sound source signals respectively emitted from the sound sources 1 and 2 (the individual sound signals) are overlapped one another and sequentially digitalized and input at a constant sampling cycle.

As illustrated in FIG. 1, the sound source separation apparatus X includes an A/D converter 21 (which is represented as ADC in the drawing), a D/A converter 22 (which is represented as DAC in the drawing), an input buffer 23, and a digital processing unit Y.

Moreover, the digital processing unit Y includes a first input buffer 31, a first FFT processing unit 32, a first intermediate buffer 33, a learning computation unit 34, a second input buffer 41, a second FFT processing unit 42, a second intermediate buffer 43, a separation filter processing unit 44, a third intermediate buffer 45, an IFFT processing unit 46, a fourth intermediate buffer 47, a synthesis process unit 48, and an output buffer 49.

Here, the digital processing unit Y is composed, for example, of a computation processor such as a DSP (Digital Signal Processor), a storage unit such as a ROM that stores a program to be executed by the processor, and other peripheral devices such as an RAM. Also, there is a case where the digital processing unit Y may also be composed of a CPU, a computer having peripheral devices, and a program to be executed by the computer. Also, functions that the digital processing unit Y has can be provided as a sound source separation program executed by a predetermined computer (which includes a processor provided to the sound source separation apparatus).

It should be noted that FIG. 1 illustrates an example where the number of channels of the input mixed sound signals xi(t) (that is, the number of the microphones) is two, but as long as the number of channels n is equal to or larger than the number of the sound source signals as the separation targets, even when the number may be 3 or larger, the present invention can be realized by the same configuration.

The A/D converter 21 performs the sampling on the respective analog mixed sound signals input from the plurality microphones 111 and 112 at the constant sampling cycle (that is, the constant sampling frequency) to be converted into the digital mixed sound signals Xi(t), and outputs (writes) the signals after the conversion to the input buffer 23. For example, in a case where the respective sound source signals Si(t) are sound signals of human voice, the digitalization may be performed at a sampling cycle of about 8 KHz.

The input buffer 23 is a memory for temporarily storing the mixed sound signal which has been digitalized by the A/D converter 21. Each time a new mixed sound signal Si(t) is accumulated in the input buffer 23 only by N/4 samples, the mixed sound signal Si(t) by the N/4 samples is transmitted from the input buffer 23 to both the first input buffer 31 and the second input buffer 41. Therefore, it suffices that the storage capacity of the input buffer 23 has N/2 samples (=N/4×2) or more.

Figure 8:
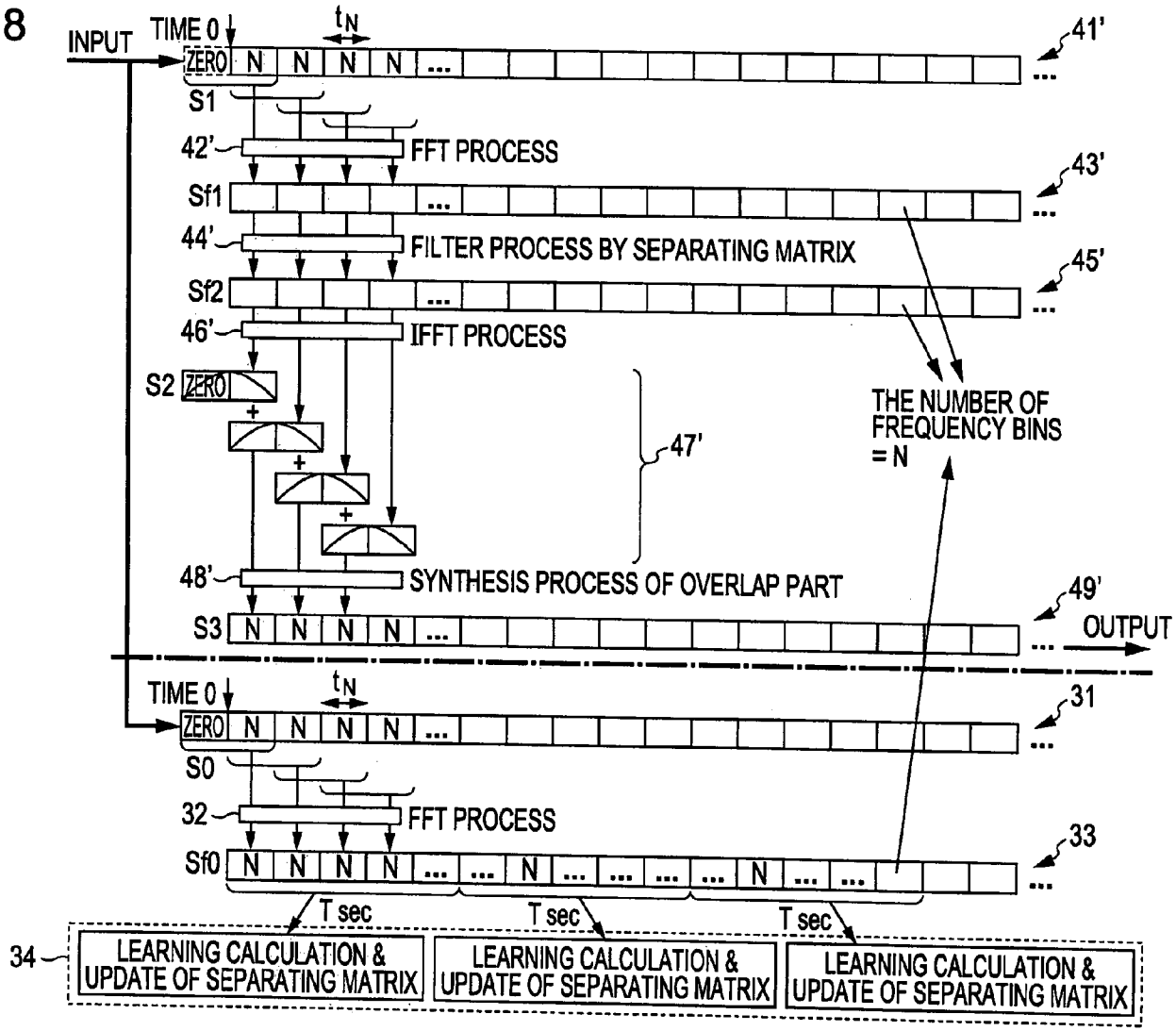
FIG. 8 is a block diagram illustrating a flow of a sound source separation process based on a conventional FDICA method.
Figures 9B, 9C, 9D, 9E:
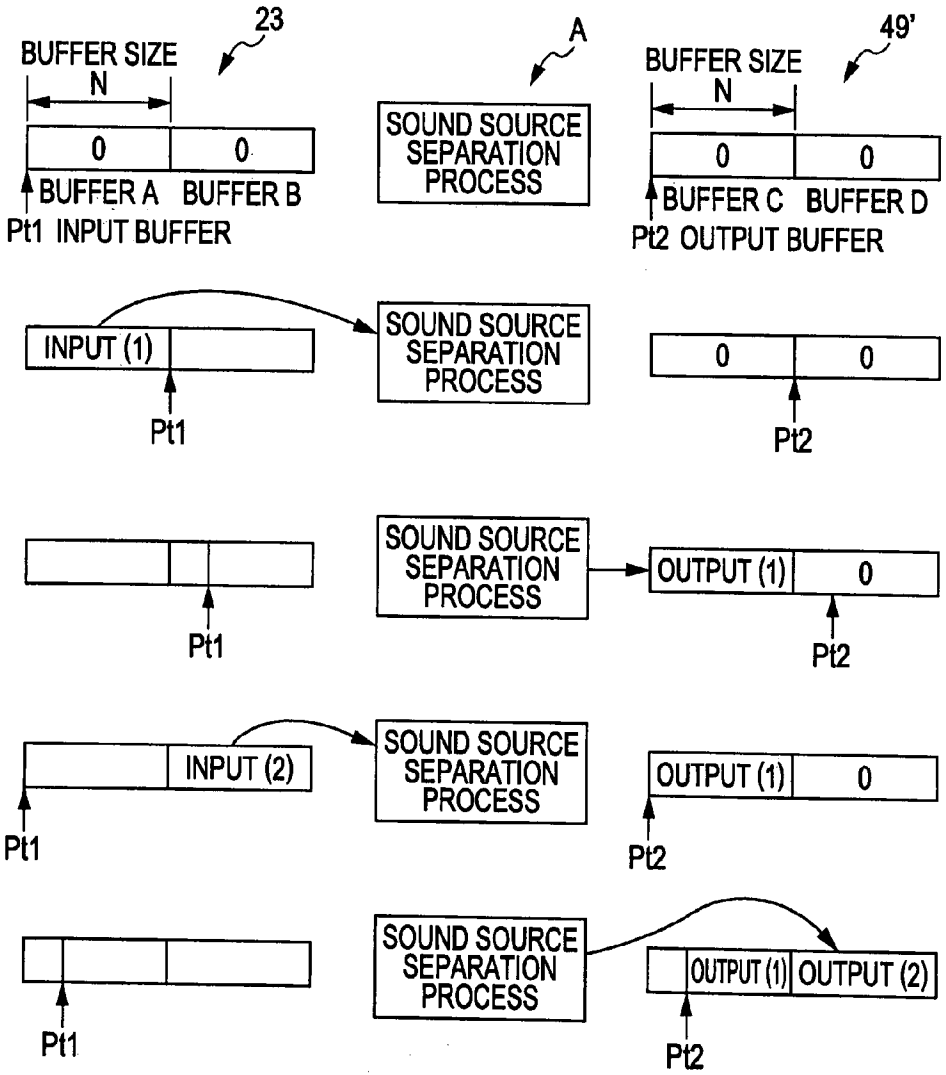

In the sound source separation apparatus X, the first input buffer 31, the first FFT processing unit 32, the first intermediate buffer 33, and the learning computation unit 34 are adopted to execute the same processes as those to be executed by the first input buffer 31, the first FFT processing unit 32, the first intermediate buffer 33, and the learning computation unit 34 in the conventional case that are illustrated in FIG. 8.

That is, the first FFT processing unit 32 executes the Fourier transform process each time the first input buffer 31 records the new mixed sound signal Si(t) by the N samples. It should be noted that the process execution cycle of the first FFT processing unit 32 (here, the time length of the next signal by the N samples) will be hereinafter referred to as the first time t1.

To be more specific, the first FFT processing unit 32 performs the Fourier transform process on the first time-domain signal S0 that is the latest mixed sound signal having at least N samples, that is, equal to or longer than the length of the first time t1 (here, 2N samples), and temporarily stores the first frequency-domain signal Sf0 obtained as a result in the first intermediate buffer 33 (an example of the first Fourier transform unit).

Then, the learning computation unit 34 (an example of the separating matrix learning calculation unit) reads, at every predetermined time Tsec, the latest first frequency-domain signal Sf0 by the time Tsec temporarily stored in the first intermediate buffer 33 and performs the learning calculation on the basis of the read signal through the above-described FDICA (the frequency-domain independent component analysis) method.

Furthermore, the learning computation unit 34 sets and updates the separating matrix (hereinafter referred to as second separating matrix) used for the separation generation of the separation signal (the filter process) (an example of the separating matrix setting unit) on the basis of the separating matrix (hereinafter referred to as first separating matrix) calculated through the learning calculation. It should be noted that the setting method for the second separating matrix will be described later.

Next, while referring to FIG. 2, the filter process according to the first embodiment by the sound source separation apparatus X will be described. FIG. 2 is a block diagram illustrating a flow of the filter process (the first embodiment) by the sound source separation apparatus X.

Here, for the convenience of description, the respective buffers shown in FIG. 2 (the second input buffer 41, the second intermediate buffer 43, the third intermediate buffer 45, the fourth intermediate buffer 47, and the output buffer 49) are described as if the buffers can accumulate an extremely large amount of data. However, in actuality, data that is no longer necessary among the stored data is sequentially deleted in the respective buffers, and as a result the resultant free space is reused. Thus, the storage capacity of the respective buffers is set to have a necessary and sufficient amount.

Each time the new mixed sound signal by the N/4 samples (an example of the new mixed sound signal by the second time length) is input (recorded) to the second input buffer 41, the second FFT processing unit 42 (an example of the second Fourier transform unit) executes the Fourier transform process on the second time-domain signal S1 including the latest mixed sound signal by the time length 2 times longer (by the N/2 samples), and temporarily stores the second frequency-domain signal Sf1 that is the process result in the second intermediate buffer 43. It should be noted that the process execution cycle of the second FFT processing unit 42 (here, the time length of the signal by the N/4 samples) is hereinafter referred to as second time t2.

In this manner, in the sound source separation process apparatus X, the execution cycle of the Fourier transform process by the second FFT processing unit 42 (that is, the second time t2) is set as a cycle shorter than the execution cycle of the Fourier transform process by the first FFT processing unit (that is, the first time t1) in advance.

Also, the second FFT processing unit 42 executes the Fourier transform process on the second time-domain signal S1 (the mixed sound signal) in which at least the time slots by N/4 samples each are subsequently overlapped one another. Here, the number of samples of the signal accumulated in the second input buffer 41 does not reach 2N (an initial stage after the process start), and the second FFT processing unit 42 executes the Fourier transform process on the signal in which value 0 is replenished by a deficient number.

It should be noted that the number of the frequency bins of this second frequency-domain signal Sf1 is ½ times (=N) as many as the number of the samples of the second frequency-domain signal Sf1.

According to this first embodiment, as the second time-domain signal S1, for example, the following signal is considerable.

First, as illustrated in FIG. 2, the second time-domain signal S1 is the latest mixed sound signal by the 2N samples.

In addition to the above, it is also conceivable that the second time-domain signal S1 is a signal in which 3N/4 of the constant signals (for example, zero-value signals) are added to the latest mixed sound signal (the latest mixed sound signal by the N/2 samples) by a time length 2 times as long as the second time t2. Such second time-domain signal S1 is set, for example, through a padding process performed by the second FFT processing unit 42.

Figures 4A, 4B, 4C:
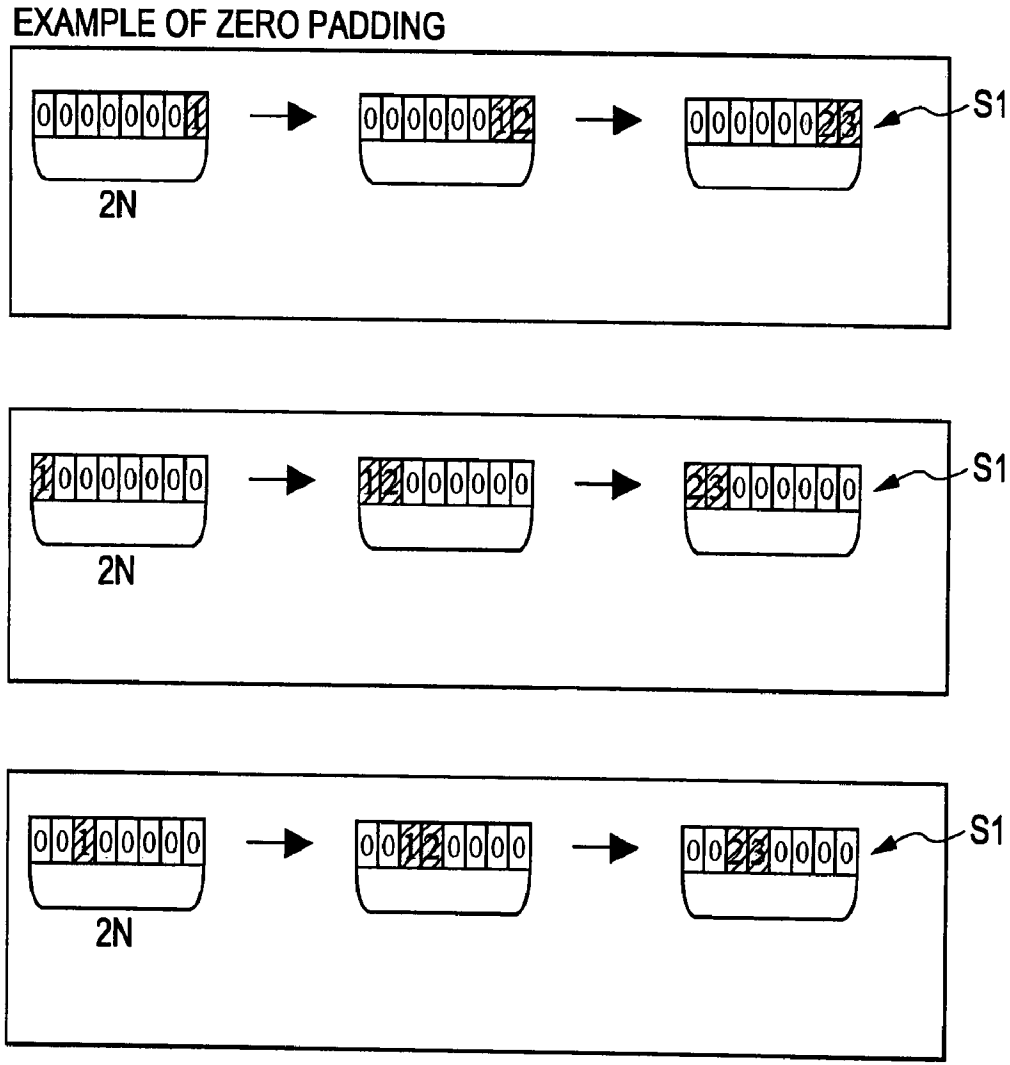
FIGS. 4A to 4C illustrate a state of a setting process for the time-domain signal by the sound source separation apparatus.

FIGS. 4A to 4C are block diagrams illustrating a process state for setting the second time-domain signal S1 through the padding process. In FIGS. 4A to 4C, each square represents the mixed sound signal set by the N/4 samples. Also, in FIGS. 4A to 4C, "0" described in each square denotes the zero-value signal, and "1" to "3" described in each square denote the numbers of time series of the mixed sound signal by the N/4 samples.

"Case 1" of FIG. 4A illustrates a process state where the second time-domain signal S1 (the next signal by the 2N samples in total) is set through the padding process in which the latest mixed sound signal by the (2N/4) samples is arranged at the end of the signal sequence and the zero-value signals (an example of the constant signal) by the (6N/4) samples are added (replenished) to the remaining parts.

"Case 2" of FIG. 4B illustrates a process state where the second time-domain signal S1 (the next signal by the 2N samples in total) is set through the padding process in which the latest mixed sound signal by the (2N/4) samples is arranged at the beginning of the signal sequence and the zero-value signals (an example of the constant signal) by the (6N/4) samples are added (replenished) to the remaining parts.

"Case 3" of FIG. 4C illustrates a process state where the second time-domain signal S1 (the next signal by the 2N samples in total) is set through the padding process in which the latest mixed sound signal by the (2N/4) samples is arranged at a predetermined intermediate position of the signal sequence and the zero-value signals (an example of the constant signal) by the (6N/4) samples are added (replenished) to the remaining parts.

Then, each time the second intermediate buffer 43 records the new second frequency-domain signal Sf1, the separation filter processing unit 44 (separation filter process unit) performs the filter process (the matrix operation) with use of the separating matrix on the signal Sf1, and temporarily stores the third frequency-domain signal Sf2 obtained through the process in the third intermediate buffer 45. The separating matrix used for this filter process is updated by the above-described learning computation unit 34. It should be noted that until the learning computation unit 34 updates the separating matrix for the first time, the separation filter processing unit 44 performs the filter process with use of the separating matrix (initial matrix) in which a predetermined initial value has been set. Here, it is needless to mention that the second frequency-domain signal Sf1 and the third frequency-domain signal Sf2 have the same number of the frequency bins (=N).

Also, each time the third intermediate buffer 45 records the new third frequency-domain signal Sf2, the IFFT processing unit 46 (an example of the inverse Fourier transform unit) executes the inverse Fourier transform process on the new third frequency-domain signal Sf2 and temporarily stores the third time-domain signal S2 that is the process result in the fourth intermediate buffer 47. The number of samples of this third time-domain signal S2 is 2 times as many as the number of the frequency bins(=N) of the third frequency-domain signal Sf2 (=2N). As described above, the second FFT processing unit 42 executes the Fourier transform process on the second time-domain signal S1 (the mixed sound signal) where the time slots are overlapped by the (7N/4) samples each, and therefore the time slots are mutually overlapped only by the (7N/4) samples each in the two continuous third time-domain signals S2 recorded in the fourth intermediate buffer 47 as well.

Furthermore, each time the fourth intermediate buffer 47 records the new third time-domain signal S2, the synthesis process unit 48 executes a synthesis process to be illustrated below to generate the new separation signal S3 and temporarily stores the signal in the output buffer 49.

Here, the above-described synthesis process is a process for synthesizing both the signals at a part where the time slots in the new third time-domain signal S2 obtained through the IFFT processing unit 46 and the third time-domain signal S2 obtained one time before are overlapped one another (here, the signal by the N/4 samples), for example, through addition by way of a crossfade weighting. As a result, the smoothed separation signal S3 is obtained.

By way of the above-described process, although some output delay is caused, the separation signal S3 corresponding to the sound source (the same as the above-described separation signal yi(t)) is recorded in the output buffer 49 in real time.

Incidentally, according to the first embodiment, such a setting is made that the time length ti of the first time-domain signal S0 (the number of samples 2N) and the time length t2 of the second time-domain signal S1 (the number of samples 2N) are equal to each other.

For this reason, the number of the frequency bins (N) of the signal Sf0 obtained through the process of the first FFT processing unit 32 and the number of the frequency bins (=N) of the signal Sf1 obtained through the process of the second FFT processing unit 42 are matched to each other.

Therefore, the learning computation unit 34 (an example of the separating matrix setting unit) sets the, first separating matrix obtained through the learning calculation as the second separating matrix used for the filter process as it is.

On the basis of the process of the learning computation unit 34, the second separating matrix used for the filter process is appropriately updated so as to be suited to the change in the acoustic environment.

In the sound source separation apparatus X that executes the filter process according to the first embodiment, the process execution cycle (the time t2) of the second FFT processing unit 42 is shorter than the process execution cycle (the time t1) of the first FFT processing unit 32. Therefore, by setting the above-described second time t2 sufficiently shorter than the conventional case (here, the time length of the signal by the N/4 samples), it is possible to significantly shorten the time of the output delay as compared with the conventional case.

On the other hand, the process execution cycle (the time t1) of the first FFT processing unit 32 can be set as a sufficiently long time (for example, this is equivalent to the signal having the length of the sampling cycle of 8 KHz×1024 samples) irrespective of the time t2. As a result, while the time of the output delay is shortened, it is possible to ensure the high sound source separation performance.

Hereinafter, effects of the sound source separation apparatus X will be described.

As described above, according to the sound source separation process based on the FDICA method, the time of the output delay becomes a time from more than 2 times to about 3 times as long as the execution cycle t2 of the process for obtaining the second frequency-domain signal Sf1 used as the input signal of the filter process (the process of the second FFT processing unit 42).

On the other hand, in the sound source separation apparatus X, the process execution cycle t2 of the second FFT processing unit 42 can be sufficiently shorter than the conventional case, and it is possible to significantly shorten the time of the output delay as compared with the conventional case. In the embodiment illustrated in FIG. 2, the time of the output delay can be set ¼ as long as the time of the output delay in the conventional sound source separation process illustrated in FIG. 8.

On the other hand, the execution cycle (the first time t1) of the Fourier transform process (the process of the first FFT processing unit 32) corresponding to the learning computation of a separating matrix can be set as a sufficiently long time (for example, this is equivalent to the signal having the length of the sampling cycle of 8 KHz×1024 samples) irrespective of the above-described second time t2.

As a result, while the time of the output delay is shortened, it is possible to ensure the high sound source separation performance.

Figure 5A:
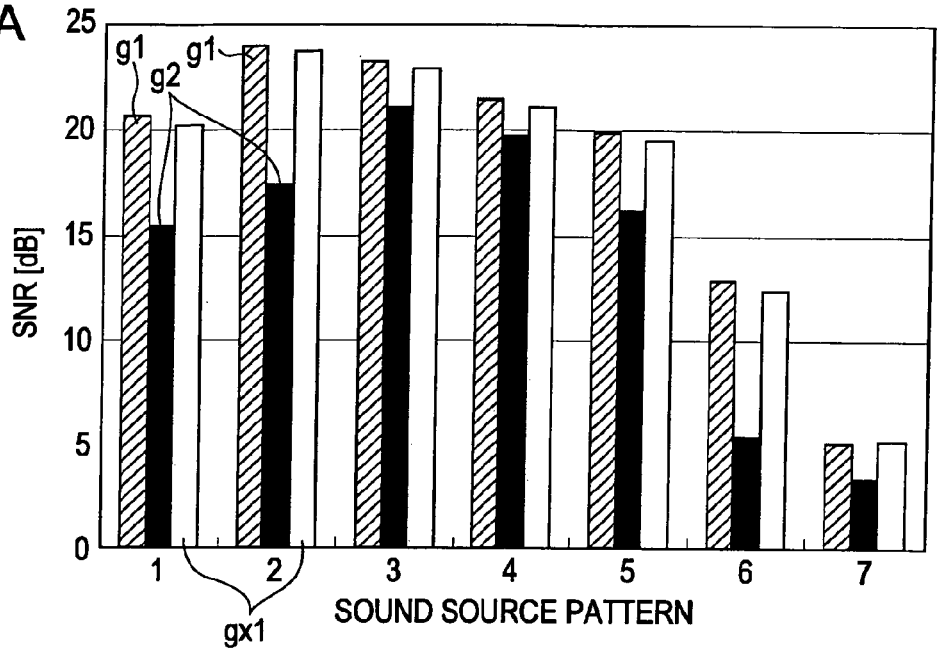
FIGS. 5A and 5B are graphs representing a process of a first embodiment by the sound source separation apparatus and a result of a performance comparison experiment with respect to a conventional sound source separation process.
Figure 5B:
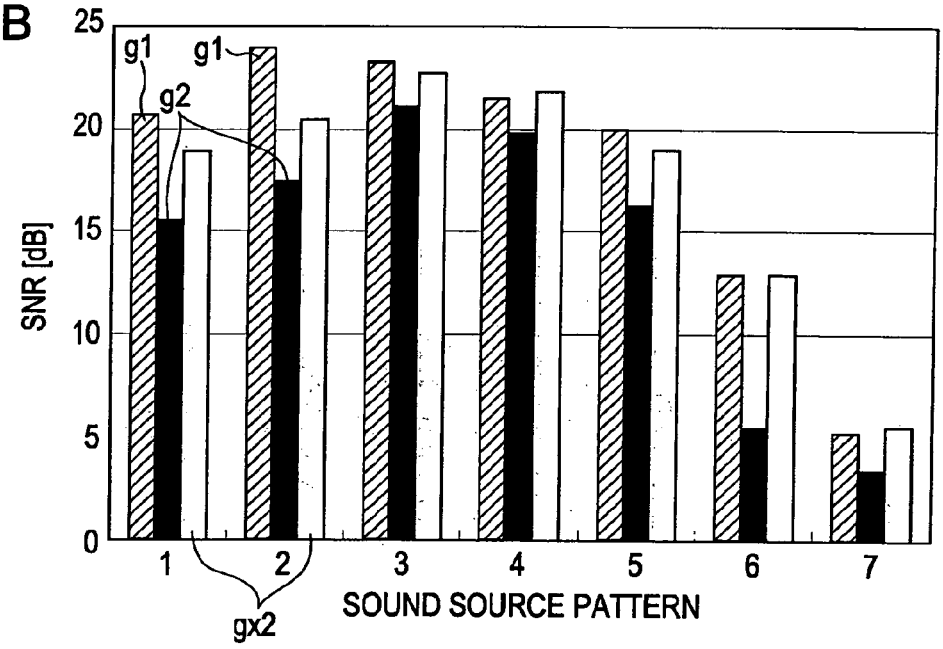

FIGS. 5A and 5B are graphs illustrating performance comparison experiences of the sound source separation process by the sound source separation apparatus X according to the first embodiment and the conventional sound source separation process.

Experimental conditions are as follows.

First, in a predetermined space, the two microphones 111 and 112 are arranged in a predetermined direction (hereinafter referred to as front face direction) respectively at left and right positions at equal distances from a certain reference position. Here, in a case where the reference position is at the center, the front face direction is set as a 0° direction, and a clockwise angle as seen from the above is set as θ.

Then, types and arrangement directions of the two sound sources (the first sound source and the second sound source) have the following seven patterns (hereinafter referred to as Sound source pattern 1 to Sound source pattern 7).

Sound source pattern 1: the type of the first sound source is a man speaking. The arrangement direction of the first sound source is a direction of θ=−30°. The second sound source is a woman speaking. The arrangement direction of the second sound source is a direction of θ=+30 v.

Sound source pattern 2: the type of the first sound source is a man speaking. The arrangement direction of the first sound source is a direction of θ=−60°. The second sound source is an automobile that emits an engine sound. The arrangement direction of the second sound source is a direction of θ=+60°.

Sound source pattern 3: the type of the first sound source is a man speaking. The arrangement direction of the first sound source is a direction of θ=−60°. The second sound source is a sound source that emits predetermined noise. The arrangement direction of the second sound source is a direction of θ=+60°.

Sound source pattern 4: the type of the first sound source is a man speaking. The arrangement direction of the first sound source is a direction of θ=−60°. The second sound source is an acoustic device that outputs predetermined classical music. The arrangement direction of the second sound source is a direction of θ=+60°.

Sound source pattern 5: the type of the first sound source is a man speaking. The arrangement direction of the first sound source is a direction of θ=0°. The second sound source is a woman speaking. The arrangement direction of the second sound source is a direction of θ=+60°.

Sound source pattern 6: the type of the first sound source is a man speaking. The arrangement direction of the first sound source is a direction of θ=−60°. The second sound source is an acoustic device that outputs predetermined classical music. The arrangement direction of the second sound source is a direction of θ=0°.

Sound source pattern 7: the type of the first sound source is a man speaking. The arrangement direction of the first sound source is a direction of θ=−60°. The second sound source is an automobile that emits an engine sound. The arrangement direction of the second sound source is a direction of θ=0°.

Also, in either of the sound source patterns, the sampling frequency of the mixed sound signal is 8 KHz.

Then, when the signal of the first sound source is set as an object signal (Signal) as a separation-target, an evaluation value (the horizontal axis of the graph) is an SN ratio (dB) showing how much the signal component (Noise) of the second sound source is mixed therein. As the value of the SN ratio is larger, it is shown that the separation performance of the sound source signal is high.

Also, in FIGS. 5A and 5B, g1 represents a result of the conventional sound source separation process illustrated in FIG. 8 (N=512) (therefore, the output delay is 192 msec). Also, g2 represents a result of the conventional sound source separation process illustrated in FIG. 8 when N=128 is set (therefore, the output delay is 48 msec).

On the other hand, in FIGS. 5A and 5B, gx1 represents a result in the sound source separation process according to the first embodiment by the sound source separation apparatus X when N=512 is set and the input signal (the second time-domain signal S1) to the second FFT processing unit 42 is the latest mixed sound signal by 2N samples (the output delay is 48 msec).

Then, g2 represents a result in the sound source separation process according to the first embodiment by the sound source separation apparatus X when N=512 is set and the input signal (the second time-domain signal S1) to the second FFT processing unit 42 is the signal based on the padding process (value 0 replenishment) as illustrated in FIGS. 4A to 4C (the output delay is 48 msec).

As is apparent from the graphs illustrated in FIGS. 5A and 5B, the process results gx1 and gx2 of the sound source separation apparatus X1 obtains substantially the same sound source separation performance (the equivalent SN ratio) with respect to the conventional process result g1 irrespective of that the time of the output delay is shortened into ¼.

Incidentally, in the conventional sound source separation, when the process cycles of both the first FFT processing unit 32 and the second FFT processing unit 42' are merely set ¼ folds (N=128) (g2), it is understood that the sound source separation performance is substantially degraded.

As illustrated above, according to the sound source separation process apparatus X, while the time of the output delay is shortened, it is possible to ensure the high sound source separation performance.

Figure 3:
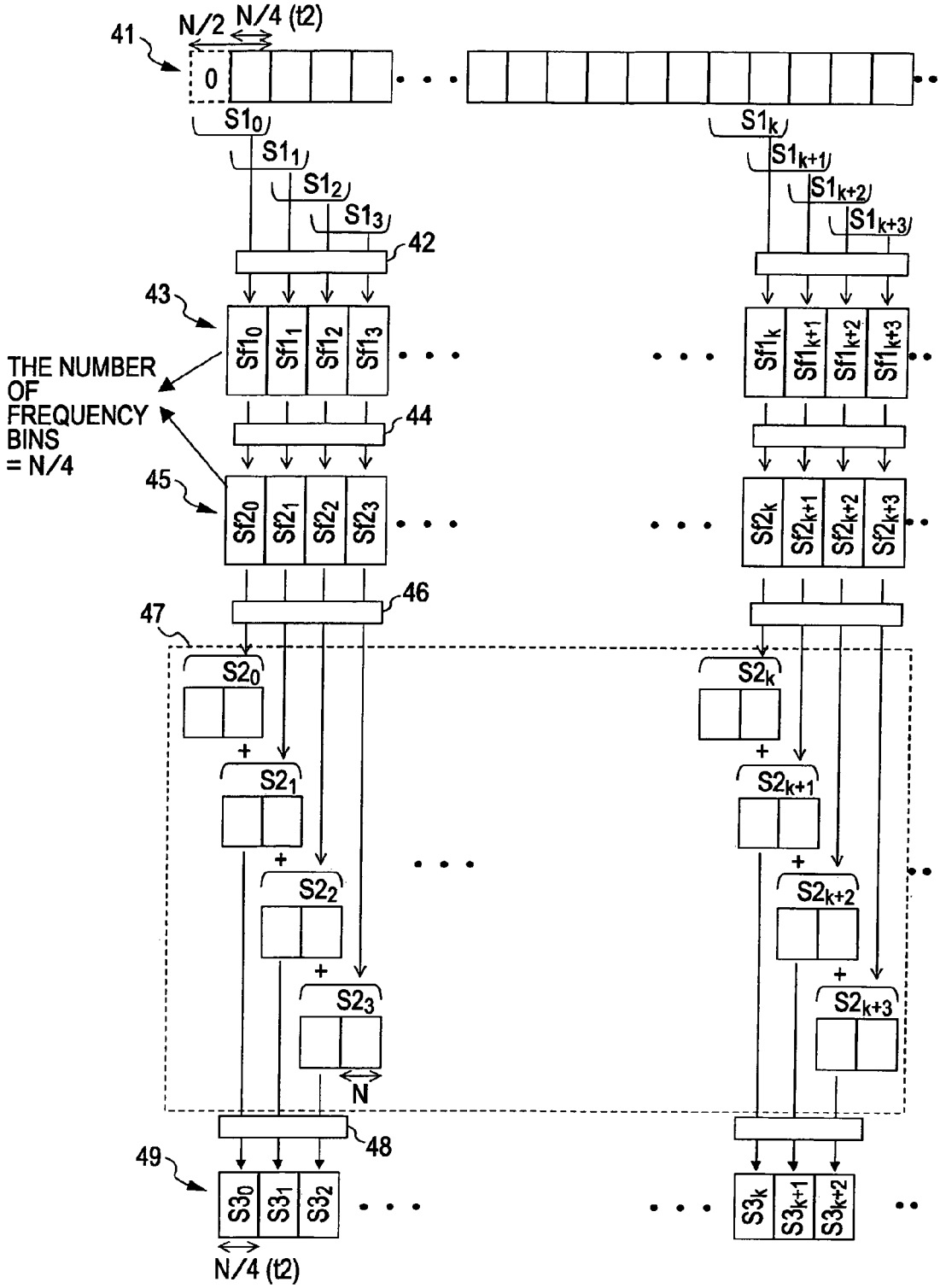
FIG. 3 is a block diagram illustrating a flow of a filter process (a second embodiment) in the sound source separation apparatus.

Second Embodiment (Refer to FIG. 3)

Next, while referring to FIG. 3, a description will be given of the filter process according to a second embodiment by the sound source separation apparatus X. FIG. 3 is a block diagram illustrating a flow of the filter process by the sound source separation apparatus X (the second embodiment).

A difference between the filter process according to this second embodiment and the filter process according to the first embodiment resides in that the number of samples of the second time-domain signal S1 is small (the time length of the signal is short). That is, according to this second embodiment, the number of samples of the second time-domain signal S1 is set shorter than the number of samples of the first time-domain signal S0. This is the same meaning as that the time length of the second time-domain signal S1 is set shorter than the time length of the first time-domain signal S0.

In the example illustrated in FIG. 3, the number of samples of the second time-domain signal S1 is set as (2N/4). On the other hand, the number of samples of the first time-domain signal S0 is 2N as in the case of the first embodiment (refer to FIG. 8). That is, such a setting is made that 4 folds of the time length of the second time-domain signal S1 (an example of an integer multiple equal to or larger than 2 folds) become the time length of the first time-domain signal S0.

As a result, the number of samples of the third time-domain signal S2 also becomes (2N/4). However, according to the first embodiment as well, the synthesis process unit 48 performs the synthesis process only on the signal by the N/4 samples where the time slots are overlapped. Therefore, according to the second embodiment as well, the process of the synthesis process unit 48 is not particularly different from the case of the first embodiment. Only a difference from the case of the first embodiment resides in that a signal that is not used for the synthesis process is not included in the third time-domain signal S2.

On the other hand, according to the second embodiment, the time length of the second time-domain signal S1 is set shorter than the time length of the first time-domain signal S0 (the number of samples is small), and therefore the number of the matrix components of the first separating matrix (the filter coefficients) obtained through the learning calculation is larger than the number of necessary and sufficient matrix components in the second separating matrix used for the filter process. Therefore, the learning computation unit 34 cannot set the first separating matrix as the second separating matrix as it is.

In an example illustrated in FIG. 3, the number of samples of the first time-domain signal S0 (2N) becomes times as many as the number of samples of the second time-domain signal S1 (=N/2), and therefore the four matrix components of the first separating matrix (the filter coefficients) the one matrix components of the second separating matrix have a mutually corresponding relation.

In view of the above, according to the second embodiment, the learning computation unit 34 (an example of the separating matrix setting unit) divides the matrix components constituting the first separating matrix (the filter coefficients) into a plurality of groups respectively corresponding to the matrix components of the second separating matrix and aggregates the matrix components (the filter coefficients) for each corresponding group, thereby calculating the separating matrix (matrix components) set as the second separating matrix.

Here, as examples of a method of aggregating the matrix components of the first separating matrix (the filter coefficients), for example, the following two methods are considerable.

One is thought to be an aggregation process of, with respect to the matrix components constituting the first separating matrix (the filter coefficients), selecting one matrix component for every a plurality of groups as a representative value. Hereinafter, this aggregation is referred to as representative value aggregation.

The other is thought to be an aggregation process of, with respect to the matrix components constituting the first separating matrix (the filter coefficients), calculating an average value of the matrix components for every a plurality of groups or calculating a weighted average value based on a predetermined weighting coefficient. Hereinafter, this aggregation is referred to as average value aggregation. It should be noted that this average value aggregation also includes a calculation of an average value or a weighted average value for a part of the matrix components in each group. For example, it is conceivable that in a case where grouping is made for every 4 matrix components (filter coefficients), an average value of predetermined 3 matrix components for each group is obtained or the like.

Through any one of these aggregation processes, the learning computation unit 34 sets the second separating matrix having the necessary and sufficient matrix components (the filter coefficients).

In such a sound source separation process according to the second embodiment as well, similarly to the case of the first embodiment, while the time of the output delay is shortened, it is possible to ensure the high sound source separation performance.

Here, the Fourier transform process corresponding to the learning calculation and the Fourier transform process corresponding to the filter process have different time lengths of the input signals (the number of samples), which may be thought to affect the sound source separation performance. However, from an experimental result to be described later, the effect is relatively small.

Figure 6A:
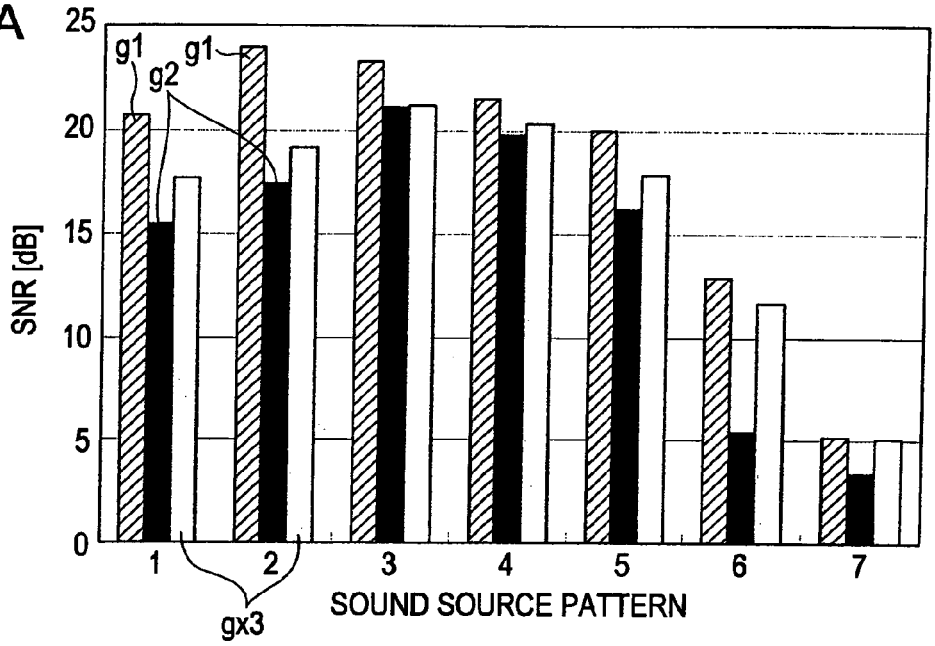
FIGS. 6A and 6B are graphs representing a process of a second embodiment by the sound source separation apparatus and a result of a performance comparison experiment with respect to the conventional sound source separation process.
Figure 6B:
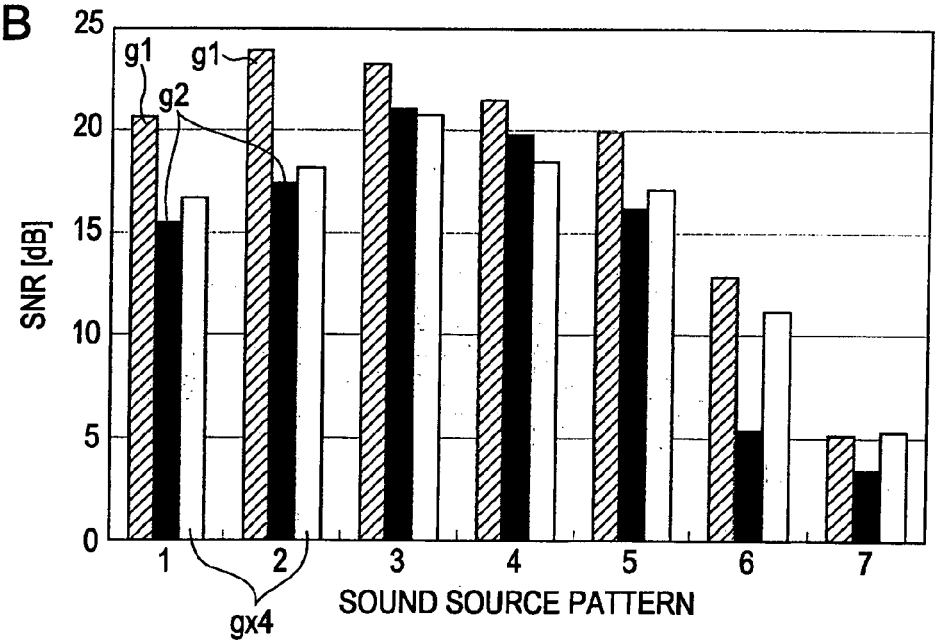

FIGS. 6A and 6B are graphs illustrating performance comparison experiences of the sound source separation process by the sound source separation apparatus X according to the second embodiment and the conventional sound source separation process.

The sound source patterns set as the experience condition are the same as the sound source pattern 1 to the sound source pattern 7 described above. Also, the sampling frequency of the mixed sound signal is 8 KHz.

Furthermore, an evaluation value (the horizontal axis of the graph) is also the same SN ratio illustrated in FIGS. 5A and 5B, and as the value is larger, it is shown that the separation performance of the sound source signal is high.

Also, in FIGS. 6A and 6B, g1 and g2 are the same experiment results as g1 and g2 illustrated in FIGS. 5A and 5B.

On the other hand, in FIGS. 6, gx3 represents a result in a case where in the process according to the second embodiment by the sound source separation apparatus X, N=512 is set, the input signal (the second time-domain signal S1) to the second FFT processing unit 42 is the latest mixed sound signal by the N/2 samples, the second separating matrix is set through and the average value aggregation (the normal average value calculation) (the output delay is 48 msec).

Then, gx4 represents a result in a case where in the process according to the second embodiment by the sound source separation apparatus X, N=512 is set, the input signal (the second time-domain signal S1) to the second FFT processing unit 42 is the latest mixed sound signal by the N/2 samples, and the second separating matrix is set through the representative value aggregation (the output delay is 48 msec).

As is apparent from the graphs illustrated in FIGS. 6A and 6B, in the process result gx3 (the average value aggregation) of the sound source separation apparatus X1, although the time of the output delay is shortened into ¼ with respect to the conventional process result g1, the sound source separation performance (the equivalent SN ratio) that is not much inferior is obtained. Also, it is understood that the process result gx3 of the sound source separation apparatus X1 obtains the high sound source separation performance (the equivalent SN ratio) in the conventional sound source separation process with respect to the case where the process cycles for both the first FFT processing unit 32 and the second FFT processing unit 42' are merely set as ¼ folds (N=128) (g2).

On the other hand, the process result gx4 (the representative value aggregation) of the sound source separation apparatus X1 does not obtain the separation performance as good as that of the process result gx3 in the case of the average value aggregation. However, the process result gx4 (the representative value aggregation) improves the separation performance in the sound source pattern where one of the sound sources is arranged in the front face as in the sound source pattern 6 or the sound source pattern 7 as compared with the process result g2. In general, the sound source pattern where one of the sound sources is arranged in the front face is a pattern with which it is difficult to obtain a high separation performance through the sound separation process based on the ICA method.

Therefore, in a case where the sound source present direction can be detected or estimated, it is conceivable that the aggregation process method for setting the second separating matrix is switched in accordance with the sound source present direction. In a similar way, in accordance with the sound source present direction, it is also conceivable that the sound source separation process method itself (either the sound source separation process according to the present invention or the conventional sound source separation process) is switched.

What is claimed is:

1. A sound source separation apparatus, comprising:

a plurality of sound input means for sequentially digitalizing a plurality of sound source signals from a plurality of sound sources at a constant sampling cycle to output the signals as a plurality of mixed sound signals;

first Fourier transform means for performing, each time the mixed sound signal by a predetermined first time length is newly obtained, a Fourier transform process on a first time-domain signal that is the latest mixed sound signal having a length equal to or longer than the first time length to be converted into a first frequency-domain signal, and for temporarily storing the first frequency-domain signal in storage means;

separating matrix learning calculation means for performing a leaning calculation through a frequency-domain independent component analysis method on the basis of one or a plurality of the first frequency-domain signals to calculate a first separating matrix;

separating matrix setting means for setting and updating a second separating matrix used for a separation generation of a separation signal that is a sound source signal corresponding to one or a plurality of the sound sources on the basis of the first separating matrix;

second Fourier transform means for performing, each time the mixed sound signal by a predetermined second time length which is shorter than the first time length is newly obtained, a Fourier transform process on a second time-domain signal that includes the latest mixed sound signal having a length two times as long as the second time length to be converted into a second frequency-domain signal, and for temporarily storing the second frequency-domain signal in storage means;

separation filter process means for performing, each time the second frequency-domain signal is newly obtained, a filter process based on the second separating matrix on the second frequency-domain signal to be converted into a third frequency-domain signal, and for temporarily storing the third frequency-domain signal in storage means;

inverse Fourier transform means for performing, each time the third frequency-domain signal is newly obtained, an inverse Fourier transform process on the third frequency-domain signal to be converted into a third time-domain signal, and for temporarily storing the third time-domain signal in storage means; and signal synthesis means for synthesizing, each time the third time-domain signal is newly obtained, both the signals at a part where time slots of the third time-domain signal and the third time-domain signal obtained one time before are overlapped one another to generate the separation signal.

2. The sound source separation apparatus according to claim 1, wherein:

the time length of the first time-domain signal and the time length of the second time-domain signal are equal to each other; and the separating matrix setting means sets the first separating matrix as the second separating matrix.

3. The sound source separation apparatus according to claim 1, wherein:

the time length of the second time-domain signal is shorter than the time length of the first time-domain signal;

the separating matrix setting means aggregates the matrix component constituting the first separating matrix for every a plurality of groups to obtain the second separating matrix.

4. The sound source separation apparatus according to claim 3, wherein an integer multiple equal to or larger than 2 times as long as the time length of the second time-domain signal is the time length of the first time-domain signal.

5. The sound source separation apparatus according to claim 3, wherein the aggregation in the separating matrix setting means is one of, with respect to the matrix component constituting the first separating matrix, a selection of one matrix component for every a plurality of groups and a calculation of an average or a weighted average of the matrix components for every a plurality of groups.

6. The sound source separation apparatus according to claim 1, wherein the second time-domain signal is the latest mixed sound signal having a length at least two times as long as the second time length.

7. The sound source separation apparatus according to claim 1, wherein the second time-domain signal is a signal in which a predetermined number of constant signals are added to the latest mixed sound signal having a length two times as long as the second time length.

8. The sound source separation apparatus according to claim 1, wherein the second time-domain signal is a signal in which a zero-value signal is added to the latest mixed sound signal having a length two times as long as the second time length.

9. A sound source separation method, comprising:

a sound input step to be performed by plural times, of sequentially digitalizing a plurality of sound source signals from a plurality of sound sources at a constant sampling cycle to output the signals as a plurality of mixed sound signals;

a first Fourier transform step of performing, each time the mixed sound signal by a predetermined first time length is newly obtained, a Fourier transform process on a first time-domain signal that is the latest mixed sound signal having a length equal to or longer than the first time length to be converted into a first frequency-domain signal, and of temporarily storing the first frequency-domain signal in storage means;

a separating matrix learning calculation step of performing a leaning calculation through a frequency-domain independent component analysis method on the basis of one or a plurality of the first frequency-domain signals to calculate a first separating matrix;

a separating matrix setting step of setting and updating a second separating matrix used for a separation generation of a separation signal that is a sound source signal corresponding to one or a plurality of the sound sources on the basis of the first separating matrix;

a second Fourier transform step of performing, each time the mixed sound signal by a predetermined second time length which is shorter than the first time length is newly obtained, a Fourier transform process on each of second time-domain signals which includes the latest mixed sound signal having a length two times as long as the second time length to be converted into a second frequency-domain signal, and of temporarily storing the second frequency-domain signal in storage means;

a separation filter process step of performing, each time the second frequency-domain signal is newly obtained, a filter process based on the second separating matrix on the second frequency-domain signal to be converted into a third frequency-domain signal, and of temporarily storing the third frequency-domain signal in storage means;

an inverse Fourier transform step of performing, each time the third frequency-domain signal is newly obtained, an inverse Fourier transform process on the third frequency-domain signal to be converted into a third time-domain signal, and of temporarily storing the third time-domain signal in storage means; and a signal synthesis step of synthesizing, each time the third time-domain signal is newly obtained, both the signals at a part where time slots of the third time-domain signal and the third time-domain signal obtained one time before are overlapped one another to generate the separation signal.

10. The sound source separation method according to claim 9, wherein:

the time length of the first time-domain signal and the time length of the second time-domain signal are equal to each other; and the separating matrix setting step includes setting the first separating matrix as the second separating matrix.

11. The sound source separation method according to claim 9, wherein:

the time length of the second time-domain signal is shorter than the time length of the first time-domain signal; and the separating matrix setting step includes aggregating the matrix component constituting the first separating matrix for every a plurality of groups to obtain the second separating matrix.

12. The sound source separation method according to claim 11, wherein an integer multiple equal to or larger than 2 times as long as the time length of the second time-domain signal is the time length of the first time-domain signal.

13. The sound source separation method according to claim 11, wherein the aggregation in the separating matrix setting step includes one of, with respect to the matrix component constituting the first separating matrix, a selection of one matrix component for every a plurality of groups and a calculation of an average or a weighted average of the matrix components for every a plurality of groups.

14. The sound source separation method according to claim 9, wherein the second time-domain signal is the latest mixed sound signal having a length at least two times as long as the second time length.

15. The sound source separation method according to claim 9, wherein the second time-domain signal is a signal in which a predetermined number of constant signals are added to the latest mixed sound signal having a length two times as long as the second time length.

16. The sound source separation method according to claim 9, wherein the second time-domain signal is a signal in which a zero-value signal is added to the latest mixed sound signal having a length two times as long as the second time length.

* * * * *